United States Patent [19]

Anthony, Jr.

[11] 3,932,169

[45] Jan. 13, 1976

[54] METHOD OF MAKING BRIQUETTES WITH MACHINE HAVING AN INERT GAS SEAL

[75] Inventor: Paul B. Anthony, Jr., Upper St. Clair Township, Allegheny County, Pa.

[73] Assignee: United States Steel Corporation, Pittsburgh, Pa.

[22] Filed: June 28, 1973

[21] Appl. No.: 374,456

[52] U.S. Cl. ..... 75/3; 425/237

[51] Int. Cl.[2] ..... B30B 11/16

[58] Field of Search ..... 425/237; 75/3; 98/36; 164/66

[56] References Cited

UNITED STATES PATENTS

| | | | |
|---|---|---|---|
| 2,785,621 | 3/1957 | Heller | 98/36 |
| 3,038,400 | 6/1962 | Ruff | 98/36 |
| 3,193,377 | 7/1965 | Guseman et al. | 75/3 |
| 3,295,952 | 1/1967 | Johnson | 75/3 |
| 3,572,422 | 3/1971 | Lyman | 164/66 X |
| 3,706,138 | 12/1972 | Schuierer | 98/36 X |

*Primary Examiner*—Robert D. Baldwin
*Attorney, Agent, or Firm*—William L. Krayer

[57] ABSTRACT

Inert gas is used to effect a seal between external oxygen-containing atmospheric gas and internal explosive or combustion-prone dust containing gases in a briquette making machine. The sealing system requires no mechanical contact and permits viewing of the moving briquette roll.

6 Claims, 2 Drawing Figures

METHOD OF MAKING BRIQUETTES WITH MACHINE HAVING AN INERT GAS SEAL

BACKGROUND OF THE INVENTION

This invention relates to briquetting machines and methods such as are used to form shapes from particulate materials. In particular it relates to means for forming briquettes from partially reduced iron ore. The invention in one embodiment represents an improvement on the device shown in U.S. Pat. No. 3,077,634 to Komarek et al., the specification of which is adopted as part of this disclosure.

Komarek shows a briquetting machine characterized by a cylindrical central body having U-shaped recesses for accommodating mold inserts. These cylindrical units are placed in tandem so that faces of two molds oppose each other as the cylinders turn, compressing the particulate material which falls between them. Temperatures of the gas inside the briquetting machine are about 1,100° – 1,400°F. Because of the large quantity of dust which is generated inside the hopper leading to the compressing zone, it has been necessary to seal off the entire machine from the atmosphere in order to prevent explosions. The large opaque housing, however, has rendered it difficult to cool the machine with water sprays and impossible to see the mold inserts for inspection; moreover, it has not been entirely free from the hazards of combustion.

Accordingly, the principal object of this invention is to provide a means of permitting the briquetting roll to rotate from the inside sealed portion of the machine to an exposed outside unsealed portion of the machine, with a seal or barrier between the inside and outside portions of the machine that does not physically contact the rotating roll. The reasons for not having a physical contact are (1) uneven surfaces on the roll of up to 0.010 inch, (2) differences in roll dimensions of up to 0.060 inch due to expansion caused by operating temperature changes, and (3) movement within the briquette machine of the briquetting roll of up to 1 inch due to operating adjustments. Benefits of the invention include longer roll life, a reduction of "stickers" in the roll pockets, and operator ability to see problems develop on the roll face before they become serious.

SUMMARY OF THE INVENTION

My invention is a sealing apparatus and method as illustrated in the accompanying drawings.

My invention provides for the continual low-pressure insertion of inert gas into the sealing edge or encasement of the briquette machine, thus allowing a clear view of empty mold inserts, and allowing the use of cooling spray also within view of the operation.

Figure 1:
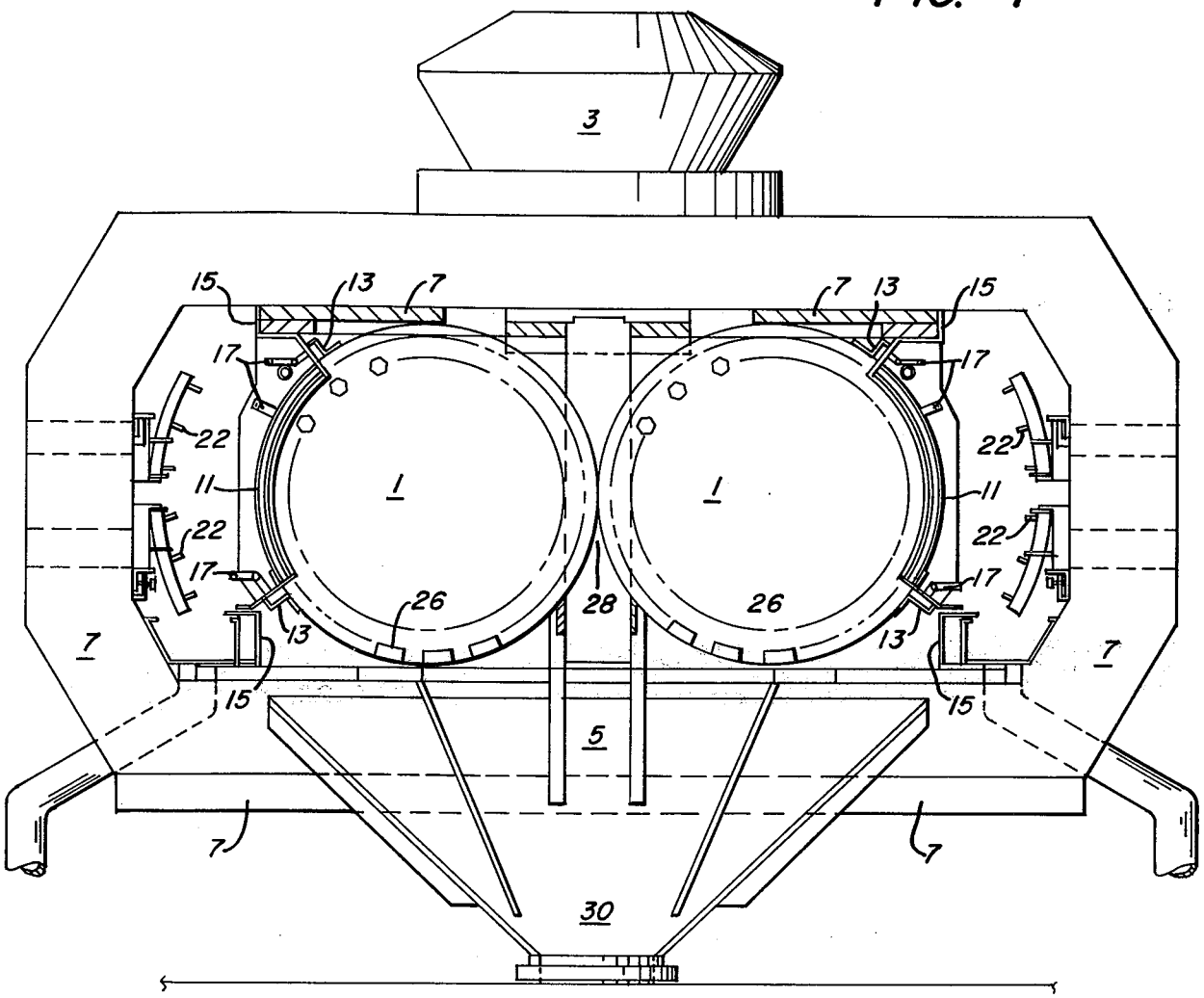
Figure 2:
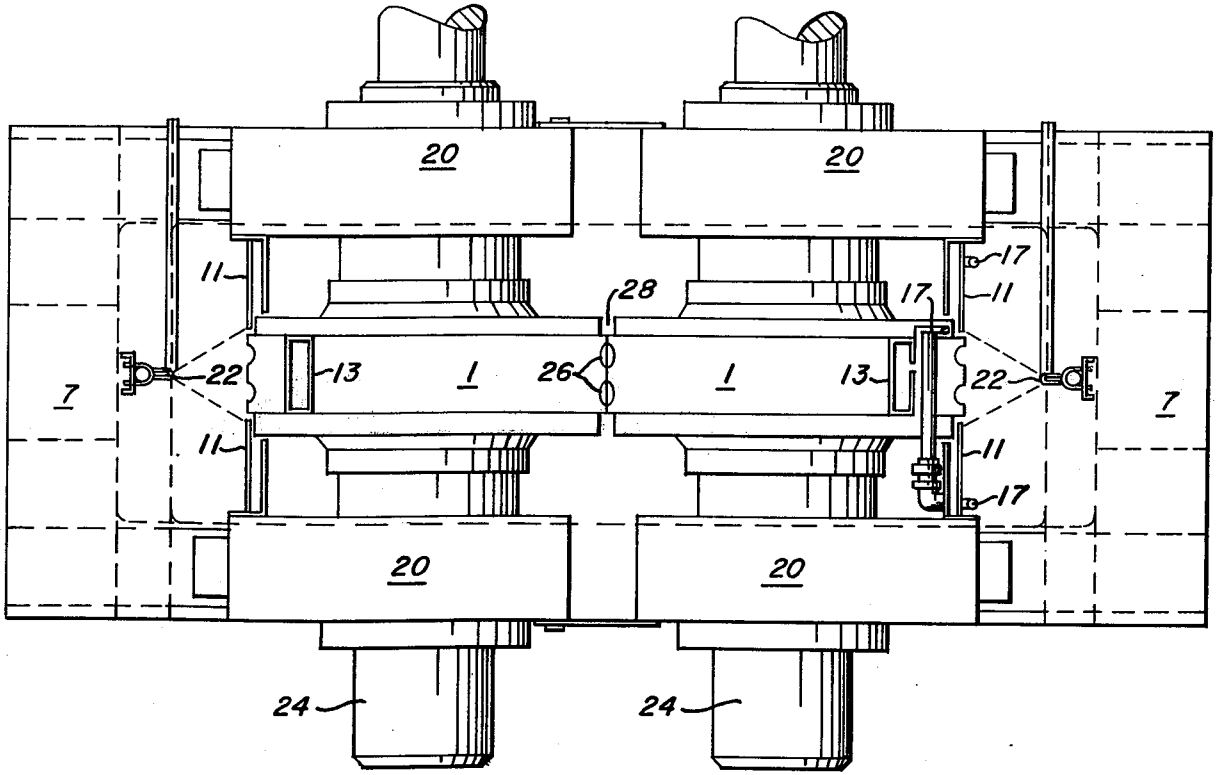

A preferred embodiment of my invention is illustrated in FIGS. 1 and 2 in which FIG. 1 is a side sectional view of a briquetting machine having two rolls; and FIG. 2 is an overhead view of the same machine.

In FIG. 1, a side sectional view of the invention, two adjacent axially parallel briquette mold rolls 1 are shown in position for compressing and molding particulate material (not shown) fed from hopper 3 through chute 5. Both rolls are housed in a case or cover 7.

My sealing mechanism is made up of side radial seals 11, end rolls face seals 13, housing seals 15, and inert gas piping 17 to the radial 11 and end 13 seals.

Left- and right-hand side radial seals 11 are firmly attached on their outside ends to the machine bearing blocks 20. The inside ends of radial seals 11 are in maximum proximity (0.010 to 0.030 inch) to the sides of the rotating briquetting roll 1 when the machine is cold and also when it is hot and in its most expanded state, since both the roll and seal expand outwardly.

Top and bottom end roll face seals 13 are firmly attached to the left- and right-hand side radial seals and are approximately 0.07 to 0.09 inch from the briquette roll face when the machine is cold; when it is hot, the expansion closes the seal to about 0.01 to 0.03 inch.

From the perspective of FIG. 1, the housing seals 15 are firmly attached to the side radial seals 11 and the end roll face seals 13, and are placed against the machine housing 7 and machine bearing blocks 20, allowing for relative operating movement between the "roll-bearing block-seal" assembly and the housing, and temperature-caused expansion movement between the roll and the seal parts as well as the "bearing block-seal" assembly and the roll. Seal spacing throughout the machine while hot and operating is maintained at about 0.01 to 0.03 inch.

In FIG. 2, an overhead view of the device, the machine bearing blocks 20 can be seen supporting shafts 24 which hold the rolls 1 having peripherally mounted molds 26 meeting in tandem at 28 as in the prior art. Piping 17 carries inert gas to sealing edges 13 and 15 where it fills the space between the moving parts and the stationary parts.

My invention operates as follows:

Inert gas is introduced substantially perpendicularly into the space of the side radial seals 11 and the end roll face seals 13 through a piping system 17. The inert gas is preferably controlled to a pressure of about 2 inch water column greater than the atmosphere on either side of the seal. The inert gas flows from the seal space out of the small slot-like openings between the seals and the roll. Some of the gas flow is into housing 7 and some of the flow is to the outside atmosphere. The positive flow of inert gas from the seal chambers prevents outside air from entering the inner portion of the briquette machine (within the housing 7) and also prevents the hot dusty combustible atmosphere on the inside of the briquette machine from escaping to the outside atmosphere. Either condition could cause a fire. The flow of inert gas into the machine housing results in a slight flow of gas through the briquette exit 30 at the bottom of the machine.

My invention permits the roll to rotate to an outer portion of the machine where inspection and cooling as by sprays 22 can take place.

No physical contact exists between the rotating roll and the seal parts. The inner briquette machine gaseous atmosphere is separated from the outer air atmosphere. The clearance between the seal and the rotating parts while in operation should be between about 0.01 inch and about 0.03 inch.

The flow of inert gas, to ensure the prevention of contact between the combustible internal gas and the oxidizing external atmospheric gas should be from 60 – 150 ft/sec in velocity; however, any flow rate will suffice if it is steady. Any inert gas may be used, but in particular, I prefer nitrogen, argon, and carbon dioxide. A mixture of nitrogen and carbon dioxide may be used.

I do not intend to be restricted to the specific illustrations and embodiments of my invention discussed above. It may be otherwise variously practiced within the scope of the following claims.

I claim:

1. In a method of making briquettes wherein particulate matter is fed through a housing to a point between two mold rolls for compression into briquettes, and wherein the atmosphere within the housing contains a combustible dust, and wherein the escape of such dust through seal openings is a fire hazard, the improvement comprising flowing inert gas into seal openings to effect flow of said inert gas both into said machine and external of said machine thereby preventing air from entering and containing the combustible dust within said housing.

2. Method of claim 1 in which the inert gas is mostly nitrogen.

3. Method of claim 1 in which the passages are from about 0.01 to b 0.03 inch wide when the machine is hot.

4. A briquette machine comprising two revolving cylindrical rolls for compressing particulate matter in mold inserts, a housing therefor and means for providing a view of empty mold inserts while sealing gases inside the machine comprising an opening in said housing having a sealing edge when heated from 0.01 to 0.03 inch away from the roll, and means for flowing inert gas into the sealing edge thereof through the edge of the housing to effect flow of inert gas into and out of said machine to contain the combustible dust wherein and prevent outside air from entering said housing.

5. Apparatus for inhibiting contact of dust-laden gases confined in a housing for briquetting machines comprising a sealing edge in said housing having a clearance from said machinery of from about 0.01 to 0.03 inch, a piping system for conveying inert gas to said sealing edge, and means for introducing inert gas from said piping system through the wall of said housing perpendicularly into the clearance to effect flow of gas transverse of said clearance, whereby the dust-laden gases are contained within and outside air prevented from entering said housing.

6. Apparatus of claim 5 in which the machines are roll-type briquetting machines.

* * * * *